United States Patent [19]

Burrous

[11] 4,015,490

[45] Apr. 5, 1977

[54] SCREW REMOVAL TOOL

[76] Inventor: William R. Burrous, 4702 Sharynne Lane, Torrence, Calif. 90505

[22] Filed: Mar. 4, 1976

[21] Appl. No.: 663,638

[52] U.S. Cl. ..... 81/180 R; 145/50 R

[51] Int. Cl.[2] ..... B25B 13/48; B25B 15/00

[58] Field of Search ..... 81/53 R, 177 R, 180 R, 81/184, DIG. 1; 145/50 R, 61 R, 61 L

[56] References Cited

UNITED STATES PATENTS

| | | | |
|---|---|---|---|
| 2,447,919 | 8/1948 | Teigen | 81/180 R X |
| 2,459,672 | 1/1949 | Morsch | 81/180 R X |
| 3,361,170 | 1/1968 | Hilton | 81/177 R X |
| 3,577,818 | 5/1971 | Cramer | 81/180 R |

*Primary Examiner*—Al Lawrence Smith
*Assistant Examiner*—James G. Smith
*Attorney, Agent, or Firm*—Joseph E. Rusz; Arsen Tashjian

[57] ABSTRACT

A tool for removing "frozen" jammed or difficult to remove screws especially in hard to reach areas where adequate pressure on the screwdriver cannot be applied. The tool is a second class lever wherein the fulcrum is a threaded member with matching threads inserted in an empty screw hole at one end and the lever extends to a pivotable handle at the other end. Intermediate the ends is a sliding block to support a screwdriver blade, socket extension and ratchet handle for turning out the jammed screw.

3 Claims, 1 Drawing Figure

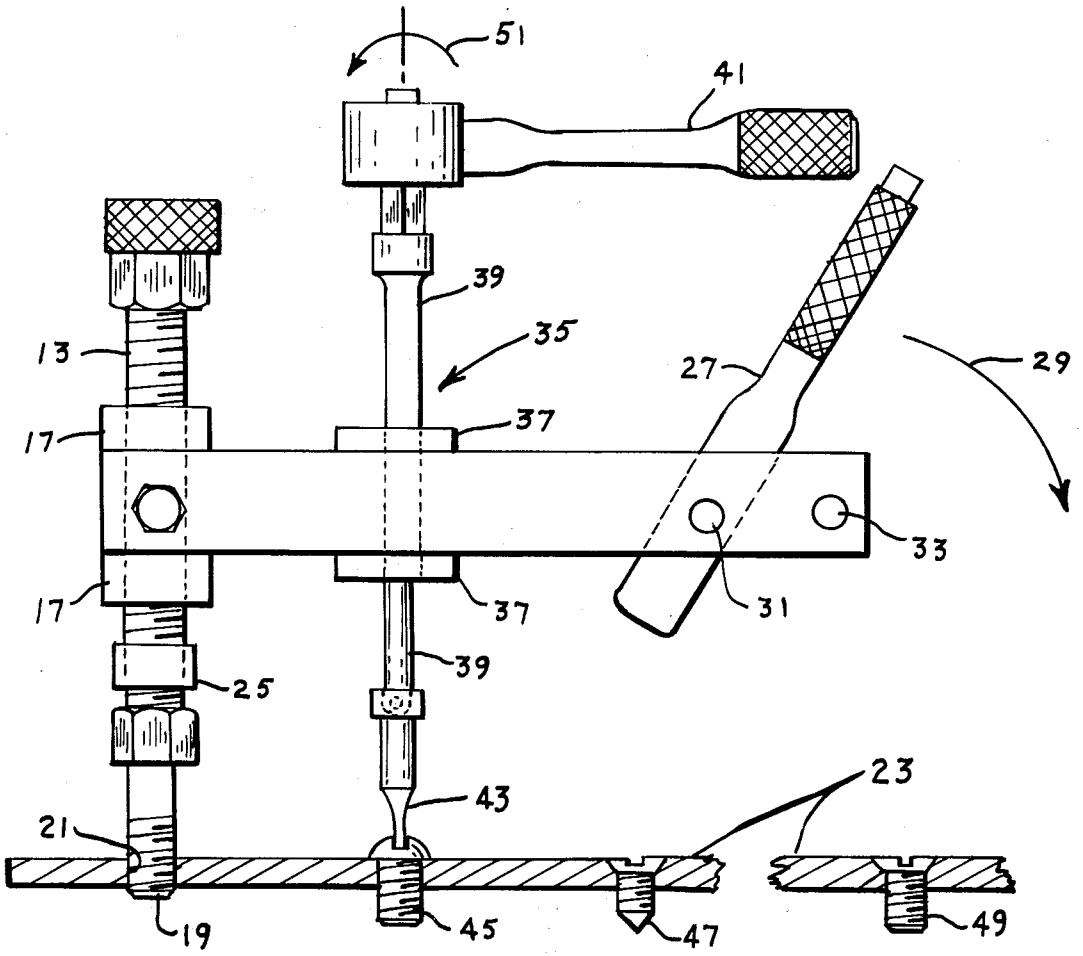
29
41
51
27
33
31
35
39
37
37
39
43
23
49
47
45
25
13
17
17
19
21

SCREW REMOVAL TOOL

STATEMENT OF GOVERNMENT INTEREST

The invention described herein may be manufactured and used by or for the Government for governmental purposes without the payment of any royalty thereon.

BACKGROUND OF THE INVENTION

This invention relates to a tool for removing hard to remove screws and, more particularly, the invention is concerned with providing a tool which utilizes the fulcrum principle by inserting the screw end into the panel and pressing against the handle on the other end causing pressure on the jammed screw from a ratchet handle screwdriver which is turned to remove the jammed screw.

Heretofore, it has been the common practice for mechanics who work on aircraft and are required to remove access panels which are attached by a series of screws to call a specialist from the machine shop when one or more of the screws are jammed. This practice causes delay in turn – around time for the aircraft and wastes a great many man hours of time in waiting for machinist support to arrive. These wasted man hours include the many specialists in the crew attached to the particular aircraft while the call is made to the shop and the machinist arrives and removes the "frozen" screws.

It would be most desirable to provide a tool which could be handled by the average aircraft mechanic or crew chief that would eliminate the necessity of calling a machinist when a hard-to-remove panel is encountered. This would allow the crew specialists to complete their job of removing the screws without ever having to call a machinist to assist in the operation. The ready accessibility of a tool of this type would effectively reduce lag time between aircraft turn-around and thus greatly enhance the operational readiness rate of the aircraft. Also, the use of this tool would eliminate an unnecessary task for machinists and allow them to work on more important tasks while allowing the crew specialists to remain at the job site and complete the job in less time.

SUMMARY OF THE INVENTION

The present invention is concerned with providing a tool which is suitable for expeditiously removing hard to remove screws from an aircraft access panel or the like. The tool includes a main horizontal beam member with a rotatable inserting screw attached at one end thereof. The lower end of the inserting screw is threaded to match the threaded holes in the aircraft. A pivotable lever handle is attached to the other end of the beam for applying downward pressure thereto. A ratchet slide block is slidably positioned on the central portion of the beam and slides horizontally so that it can be positioned directly over the "frozen" screw. A suitable screwdriver blade or socket is attached to the lower end of an extension extending downward from the ratchet slide block and a ratchet handle is attached at the upper end of an extension on the upper side of the ratchet slide block.

In operation, the threaded end of the inserting screw is threaded into one of the holes from which a screw has been removed. The ratchet slide block is then positioned on the beam member in alignment with one of the "frozen" screws with a suitable screwdriver blade or socket in place on the screw. Downward force is then applied to the lever handle causing a corresponding pressure on the "frozen" screw head by the screwdriver blade. The screw can then be unscrewed by turning the ratchet handle at the upper end of the ratchet slide block extension.

Accordingly, it is an object of the invention to provide a screw removal tool which is suitable for removing hard to remove screws from aircraft access panels or the like.

Another object of the invention is to provide a screw removal tool which utilizes the lever -fulcrum principle to apply pressure to the hard to remove screw while at the same time turning a ratchet handle to remove the screw.

Still another object of the invention is to provide a screw removal tool which can be operated by most crew specialists thereby eliminating the need for skilled machinists to be called to remove so-called "frozen" screws.

A further object of the invention is to provide a screw removal tool which is rigidly attached to the area housing the screw to be removed causing the tool to remain in position once attached without exerting pressure on the lever handle.

A still further object of the invention is to provide a screw removal tool that can be used by both right and left handed mechanics and can be used either right side up or upside-down to remove the most stubborn panel fastening screws.

These and other objects, features and advantages will become more apparent after considering the following detailed description taken in conjunction with the annexed drawing and appended claims.

BRIEF DESCRIPTION OF THE DRAWING

The drawing is a view in side elevation of the screw removal tool according to the invention showing the inserting screw, main beam and lever handle with the ratchet slide block in position on the main beam.

DESCRIPTION OF A PREFERRED EMBODIMENT

Referring now to the drawing, the screw removal tool according to the invention includes four primary parts. A free turning vertically oriented shaft 13 is positioned at one end of a horizontally disposed main beam member 15. The shaft 13 passes through a bushing 17 which is affixed to the beam 15 allowing rotating movement of the shaft 13 therethrough. A knurled knob is placed on the upper end of the shaft 13 to facilitate the rotation thereof and a threaded inserting screw 19 is attached to the lower end of the shaft 13 for engagement with a threaded hole 21 from which one of the screws of the panel 23 has been removed. An adjustable stop 25 is positioned at the lower end of the shaft 13 between the inserting screw 19 and the bushing 17.

At the other end of the main beam member 15, there is a pivotally attached lever handle 27 for applying downward pressure to the main beam 15 in the direction of the arrow 29. The handle 27 rotates around the pin 31 until it reaches the stop 33 at which time the downward force is applied.

In between the free turning shaft 13 and the lever handle 27 along the beam 15, there is positioned a driver assembly 35 which includes a slide block 37 for lateral movement along the beam 15. A vertically oriented extension rod 39 passes through the slide block 37 and extends from the panel 23 upward to permit a ratchet handle 41 to be attached to the upper end thereof. A socket screwdriver blade 43 is attached to the lower end of the extension rod 39 for engagement with the head of a "frozen" screw 45 in the panel 23. Although the screw 45 is shown having a round head, it could be of the pointed flat head type 47 or the blunt flat head type 59. By turning the ratchet handle 41 in the direction of the arrow 51 while pressing the handle 27 in the direction of the arrow 29, the "frozen" screw 45 can be easily removed.

From the foregoing description, it can be seen that the screw 45 is located between a vice created by the panel 23 from which the screw 45 is being removed from and the main beam member 15. Because of this rigid vice principle, the screw 45 can be removed completely without the use of any other tool while the pressure on the screw 45 can be varied to any degree desired simply by applying more or less downward force on the lever handle 27.

Although the invention has been illustrated in the accompanying drawings and described in the foregoing specification in terms of a preferred embodiment thereof, the invention is not limited to this embodiment or to the particular configuration disclosed. It will be apparent to those skilled in the art that certain changes, modifications and substitutions can be made, particularly with respect to the construction details, without departing from the true spirit and scope of the appended claims.

Having thus set forth the nature of my invention, what I claim and desire to secure by Letters Patent of the United States is:

1. A screw removal tool removing difficult to remove screws in hard to reach areas comprising, a horizontally disposed beam member in spaced parallel relationship to the workpiece, a free turning vertically oriented shaft positioned at one end of said beam member, an inserting screw attached to the lower end of said free turning shaft for insertion into a threaded opening in the workpiece, a lever handle attached to the other end of said beam ember for applying downward pressure thereto, and a driver assembly positioned on said main beam member between said handle and said free turning shaft, said driver assembly including a slide block disposed on said beam member to permit said driver assembly to be axially aligned over the difficult to remove screw and rotated while applying downward pressure to said lever handle thereby causing the screw to be loosened.

2. The screw removal tool defined in claim 1 wherein said lever handle is pivotably attached to said beam member to permit the tool to be used by both left-handed and right-handed persons.

3. The screw removal tool defined in claim 1 wherein said driver assembly includes a ratchet handle attached to the upper end thereof and a socket screwdriver blade attached to the lower end thereof to engage the difficult to remove screw in the workpiece.

* * * * *